US009911522B2

(12) United States Patent
Inoue et al.

(10) Patent No.: US 9,911,522 B2
(45) Date of Patent: Mar. 6, 2018

(54) WIRING HARNESS AND COAXIAL WIRE

(71) Applicant: Yazaki Corporation, Tokyo (JP)

(72) Inventors: Shuichi Inoue, Susono (JP); Taketo Kumada, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/450,621

(22) Filed: Mar. 6, 2017

(65) Prior Publication Data

US 2017/0178768 A1 Jun. 22, 2017

Related U.S. Application Data

(63) Continuation of application No. PCT/JP2015/078684, filed on Oct. 8, 2015.

(30) Foreign Application Priority Data

Oct. 10, 2014 (JP) ..... 2014-208783
Oct. 10, 2014 (JP) ..... 2014-208784

(51) Int. Cl.
*H01B 11/18* (2006.01)
*H01B 11/20* (2006.01)

(52) U.S. Cl.
CPC ..... *H01B 11/1843* (2013.01); *H01B 11/203* (2013.01)

(58) Field of Classification Search
CPC ..... H01B 7/17; H01B 11/18; H01B 7/00
See application file for complete search history.

(56) References Cited

U.S. PATENT DOCUMENTS 6,766,578 B1 * 7/2004 Swanson ..... H01B 7/0823 156/269
7,084,343 B1 * 8/2006 Visser ..... C09D 167/00 174/102 R (Continued)

FOREIGN PATENT DOCUMENTS

JP 2009-146704 A 7/2009
JP 2010-186722 A 8/2010

(Continued)

OTHER PUBLICATIONS

International Search Report dated Dec. 28, 2015 issued by International Searching Authority in counterpart International Application No. PCT/JP2015/078684 (PCT/ISA/210).

(Continued)

*Primary Examiner* — Michael F McAllister
(74) *Attorney, Agent, or Firm* — Sughrue Mion, PLLC

(57) ABSTRACT

A wiring harness includes an electric wire having a conductor part and an insulator, the insulator covering an outer periphery of the conductor part and containing a plasticizer, and a coaxial wire having an internal conductor, an internal insulator, an external conductor, and a sheath, the internal insulator provided on an outer periphery of the internal conductor, the external conductor provided on an outer periphery of the internal insulator, and the sheath covering an outer periphery of the external conductor. The coaxial wire is arranged adjacent to the electric wire. The coaxial wire comprises a film layer which is provided between the internal insulator and the external conductor and which prevents transfer of the plasticizer. A contact force between the internal insulator and the film layer is 1N or more.

2 Claims, 4 Drawing Sheets

(56) References Cited

U.S. PATENT DOCUMENTS

| | | | | |
|---|---|---|---|---|
| 9,466,406 | B2 * | 10/2016 | Shimizu | H01B 11/00 |
| 2003/0044606 | A1 * | 3/2003 | Iskander | C09J 123/06 428/375 |
| 2004/0144560 | A1 * | 7/2004 | Maydanich | H01B 7/0861 174/117 F |
| 2010/0206610 | A1 | 8/2010 | Yagi | |
| 2010/0281684 | A1 * | 11/2010 | Selbach | G02B 6/4472 29/745 |
| 2014/0027149 | A1 | 1/2014 | Shimizu et al. | |

FOREIGN PATENT DOCUMENTS

| | | | |
|---|---|---|---|
| JP | 2012-119231 | * | 6/2012 |
| JP | 2012-119231 | A | 6/2012 |
| JP | 2012-138285 | * | 7/2012 |
| JP | 2012-138285 | A | 7/2012 |
| JP | 2012-221628 | * | 11/2012 |
| JP | 2012-252930 | A | 12/2012 |
| JP | 2013-218844 | A | 10/2013 |
| JP | 2014-089944 | * | 5/2014 |
| WO | 2012/137850 | A1 | 10/2012 |

OTHER PUBLICATIONS

Written Opinion dated Dec. 28, 2015 issued by International Searching Authority in counterpart International Application No. PCT/JP2015/078684 (PCT/ISA/237).

Office Action dated Mar. 7, 2017 issued by the Japanese Patent Office in counterpart Japanese Patent Application No. 2014-208784.

Communication issued by the Japanese Patent Office dated Aug. 1, 2017 in counterpart Japanese Patent Application No. 2014-208783.

Communication issued by the Japanese Patent Office dated Aug. 1, 2017 in counterpart Japanese Patent Application No. 2014-208784.

Communication issued by the State Intellectual Property Office of P.R. China dated Nov. 3, 2017 in counterpart Chinese Patent Application No. 201580048638.5.

* cited by examiner

WIRING HARNESS AND COAXIAL WIRE

CROSS REFERENCE TO RELATED APPLICATIONS

This application is a continuation of PCT application No. PCT/JP2015/078684, which was filed on Oct. 8, 2015 based on Japanese Patent Application (No. 2014-208783) filed on Oct. 10, 2014 and Japanese Patent Application (No. 2014-208784) filed on Oct. 10, 2014, the contents of which are incorporated herein by reference.

BACKGROUND OF THE INVENTION

1. Field of the Invention

The present invention relates to a wiring harness and a coaxial wire.

2. Description of the Related Art

Conventionally, a coaxial wire having an internal conductor, an internal insulator which is provided on an outer periphery of the internal conductor, and a sheath covering an outer periphery of the external conductor has been proposed. In the coaxial wire of this type, by interrupting exterior noises by the external conductor, superposition of the noises on the data which are transmitted through the internal conductor is prevented (Reference should be made, for example, to JP-A-2010-186722, JP-A-2009-146704, JP-A-2012-119231 and JP-A-2012-138285).

By the way, when a wiring harness is formed using the coaxial wire and the other wire, in case where the coaxial wire is arranged near the wire having an insulator which contains a plasticizer (for example, a PVC wire), as the other wire, the plasticizer contained in the PVC wire may be volatilized under high temperature environment and transferred to the coaxial wire, in some cases. In this case, there is such possibility that dielectric constant of the internal insulator is enhanced due to the plasticizer which is transferred to the coaxial wire, and shielding performance of the coaxial wire is deteriorated.

On the other hand, even in case where the coaxial wire is used alone, the sheath of the coaxial wire contains the plasticizer, in some cases. This plasticizer is transferred to the coaxial wire under the high temperature environment, in the same manner as described above, and may be a cause for deterioration of the shielding performance of the coaxial wire.

SUMMARY OF THE INVENTION

The invention has been made in view of the above described circumstances, and it is an object of the invention to provide a wiring harness and a coaxial wire capable of restraining deterioration of shielding performance.

In order to attain the above described object, the wiring harness and the coaxial wire according to the invention are characterized in the features as described in the following items (1) to (5).

(1) A wiring harness comprising:

an electric wire having a conductor part and an insulator, the insulator covering an outer periphery of the conductor part and containing a plasticizer; and a coaxial wire having an internal conductor, an internal insulator, an external conductor, and a sheath, the internal insulator provided on an outer periphery of the internal conductor, the external conductor provided on an outer periphery of the internal insulator, and the sheath covering an outer periphery of the external conductor, wherein the coaxial wire is arranged adjacent to the electric wire; and wherein the coaxial wire comprises a film layer which is provided between the internal insulator and the sheath and which prevents transfer of the plasticizer.

(2) The wiring harness as described above in item (1), wherein the film layer is provided between the internal insulator and the external conductor, and is fused to the internal insulator.

(3) A wiring harness as described above in item (2), wherein a contact force between the internal insulator and the film layer is 1N or more.

(4) A coaxial wire comprising:

an internal conductor;

an internal insulator provided on an outer periphery of the internal conductor;

a film layer provided on an outer periphery of the internal conductor for preventing transfer of a plasticizer;

an external conductor provided on an outer periphery of the film layer; and an insulative sheath covering an outer periphery of the external conductor, wherein the internal insulator and the film layer are fused to each other.

(5) The coaxial wire as described above in item (4), wherein a contact force between the internal insulator and the film layer is 1N or more.

According to the wiring harness having the structure as described above in item (1), the film layer for preventing transfer of the plasticizer is provided between the internal insulator and the sheath of the coaxial wire. For this reason, it is possible to prevent transfer of the plasticizer to the internal insulator of the coaxial wire, even under high temperature environment. As the results, according to the wiring harness having this structure, it is possible to restrain deterioration of the shielding performance due to the plasticizer.

According to the wiring harness having the structure as described above in item (2), the internal insulator and the film layer of the coaxial wire are fused to each other. Therefore, even though damage or the like (a gap or the like) happens to occur in the film layer due to a work for an end part when the coaxial wire is used, the film layer is prevented from being peeled off from the internal conductor (details will be described below). As the results, in addition to restraint of the deterioration of the shielding performance as described above, it is possible to prevent defective connection due to such phenomenon that the film layer which has been peeled off may cover the end part of the coaxial wire (particularly, the internal conductor to be connected to a terminal or the like).

The work for the end part when the coaxial wire is used will be briefly described. As shown in FIG. 4A, when the coaxial wire is used, four layers including the sheath 50 to the internal insulator 20 are removed from the internal conductor 10, as a first step. As the results, the internal conductor 10 is exposed. Then, as shown in FIG. 4B, two layers including the sheath 50 and the external conductor 40 are cut off by means of a rotary cutter or the like, at a position separated from an end face T of the internal insulator 20 by a predetermined length L, and peeled off from the film layer 30. In this manner, the internal conductor 10 and the external conductor 40 are separated from each other by the length L in an axial direction of the coaxial wire 1, so that contact between the both conductors can be prevented.

However, when the two layers including the sheath 50 and the internal conductor 40 are cut off, damage (a gap G) may occur in the film layer 30 by the rotary cutter or the like, in some cases. On this occasion, there is such possibility that a film portion 30*a* at a distal end side from the gap G may be peeled off from the internal insulator 20, unless the film layer 30 is sufficiently fixed to the internal insulator 20. Then, in case where the film portion 30*a* covers the internal conductor 10 which is exposed, there is such possibility that defective connection may occur, when the internal conductor 10 and a terminal or the like are connected (press-fitted) to each other.

According to the wiring harness having the structure as described above in item (3), the contact force between the internal insulator and the film layer is 1N or more (definition will be described below). According to a test carried out by the inventor, in case where the contact force is 1N or more, removal of the film layer did not occur in all of a sufficient number of samples (the number of the samples was 50), on condition that a distance of the film portion in a longitudinal direction of the wire (the above described length L) is about 0.5 mm. Accordingly, it is possible to more reliably prevent defective connection, in case where the contact force is 1N or more.

The contact force in this invention is defined as a value which is measured using a test method which will be described below. Specifically, on condition that an area where the internal insulator which is exposed to the exterior and the film layer are fused to each other (a fused area) is 50 $mm^2$, in case where a force for pulling the film layer in an axial direction of the internal insulator (a force for peeling off the film layer) is gradually increased, a magnitude of the force at a time point when the film layer is peeled off from the internal insulator is defined as the contact force in this invention. More specific test method will be described below.

According to the coaxial wire having the structure as described above in item (4), the internal insulator and the film layer are fused to each other, in the same manner as described above in item (2). Therefore, even though the damage (the gap or the like) occurs in the film layer due to the work for the end part or so, the film layer is prevented from being peeled off from the internal insulator. Accordingly, in addition to restraint of the deterioration of the shielding performance as described above, it is possible to prevent defective connection due to such phenomenon that the film layer which has been peeled off covers the end part of the coaxial wire (particularly, the internal conductor to be connected to the terminal or so).

According to the coaxial wire having the structure as described above in item (5), the contact force between the internal insulator and the film layer is 1N or more (definition will be described below). According to a test carried out by the inventor, in case where the contact force is 1N or more, removal of the film layer did not occur in all of a sufficient number of samples (the number of the samples was 50), on condition that a distance of the film portion in a longitudinal direction of the wire (the above described length L) is about 0.5 mm. Accordingly, it is possible to more reliably prevent defective connection, in case where the contact force is 1N or more.

According to the present invention, it is possible to provide the wiring harness and the coaxial wire capable of restraining deterioration of the shielding performance.

BRIEF DESCRIPTION OF THE DRAWINGS

FIGS. 3A and 3B are structural views showing the coaxial wire which is shown in FIG. 1, of which FIG. 3A is a sectional view and FIG. 3B is a side view.

FIGS. 4A and 4B are views showing working processes when the coaxial wire is used, of which FIG. 4A shows a first process, and FIG. 4B shows a second process.

FIGS. 5A to 5C are views showing a method of measuring a contact force, of which FIG. 5A is a first view, FIG. 5B is a second view, and FIG. 5C is a third view.

DETAILED DESCRIPTION OF THE EXEMPLARY EMBODIMENTS

A preferred embodiment of the present invention will be described below. However, the invention is not limited to the embodiment as described below.

Figure 1:
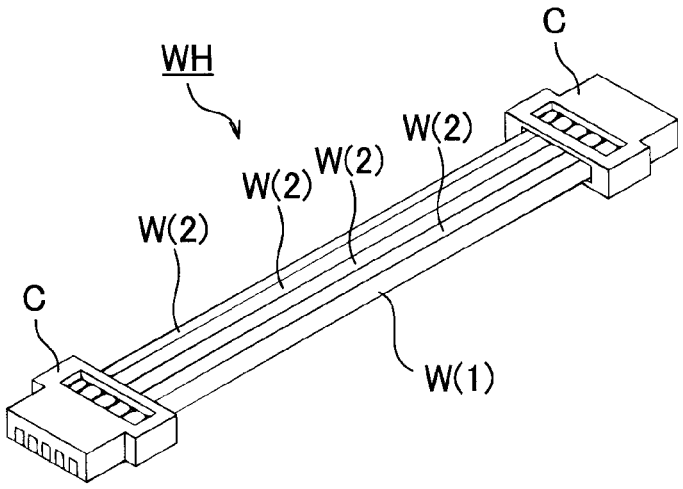
FIG. 1 is a perspective view showing an example of a wiring harness according to an embodiment of the invention.

FIG. 1 is a perspective view showing an example of a wiring harness according to an embodiment of the invention. As shown in FIG. 1, a wiring harness WH is formed by bundling a plurality of wires W (a coaxial wire 1 and electric wires 2 which will be described below). In this embodiment, at least one of a plurality of the electric wires W is the coaxial wire 1 which will be described below.

Figure 2:
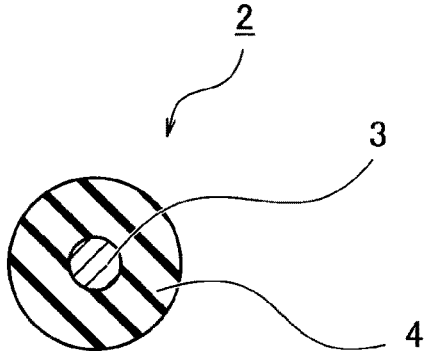
FIG. 2 is a sectional view of an example of the other wire excluding a coaxial wire.

FIG. 2 is a sectional view showing an example of the other electric wire 2 excluding the coaxial wire 1. The other electric wire 2 is a PVC wire, for example, and includes a conductor part 3, and an insulator 4 containing a plasticizer and covering an outer periphery of the conductor part 3.

In the wiring harness WH, the coaxial wire 1 is arranged near the other electric wire 2 (specifically, at a position adjacent to the other electric wire 2). As shown in FIG. 1, the wiring harness WH may be provided with connectors C which are disposed at both ends of the wires W, and may be wrapped with a tape (not shown) in order to bundle a plurality of the wires W. The wiring harness WH may be provided with an exterior component (not shown) such as a corrugate tube.

Figure 3A:
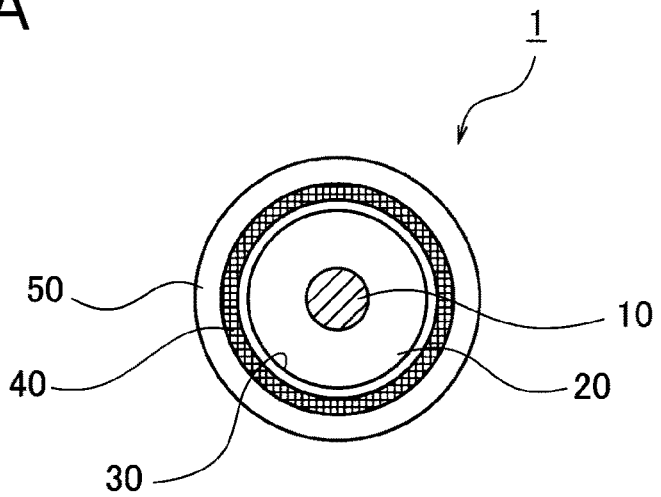
Figure 3B:
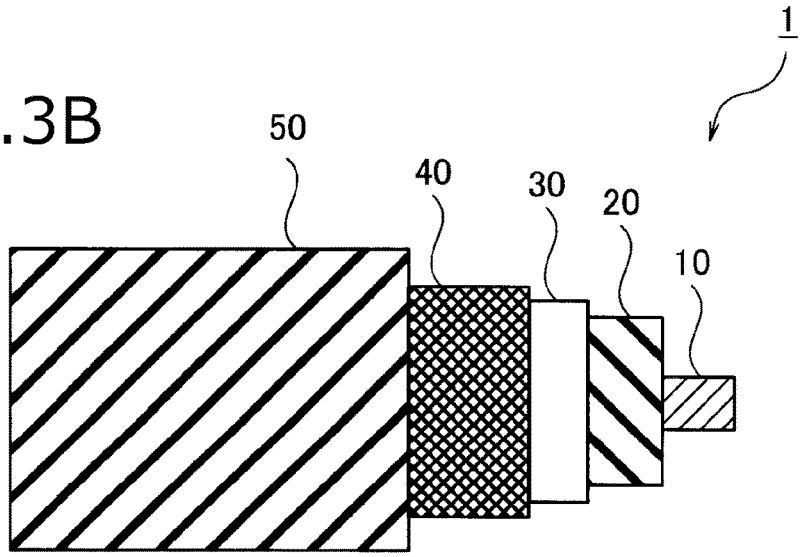

FIGS. 3A and 3B are structural views showing the coaxial wire 1, of which FIG. 3A is a sectional view and FIG. 3B is a side view. As shown in FIGS. 3A and 3B, the coaxial wire 1 includes an internal conductor 10, an internal insulator 20, a film layer 30, an external conductor 40, and an insulating sheath 50.

As the internal conductor 10, for example, annealed copper wire, silver-plated annealed copper wire, tin-plated annealed copper wire, and tin-plated copper alloy wire or the like can be used. Although the internal conductor 10 is composed of a single conductor in this embodiment, it is to be noted that the internal conductor 10 may be formed of a twisted wire including two or more conductors (wires) which have been twisted together.

The internal insulator 20 is provided on an outer periphery of the internal conductor 10. As the internal conductor 10, for example, PE (polyethylene) and PP (polypropylene) or the like can be used. In this embodiment, dielectric constant of the internal insulator 20 is 3.0 or less.

The film layer 30 is a sheet-like member which is provided on an outer periphery of the internal insulator 20 for the purpose of preventing transfer of the plasticizer. Specifically, the film layer 30 can be formed of substance (for example, PET (polyethylene terephthalate)) having a difference of 1.8 or more in solubility parameter (SP value) with respect to the plasticizer which is commonly used (DOP: bis (2-ethylhexyl) phthalate, DINP: diisononyl phthalate, and TOTM: trioctyl trimellitate). With this film layer 30, it is possible to prevent the plasticizer from penetrating into the internal insulator 20. For reference, the SP value of the above described common plasticizer is 8.9. The film layer 30 is preferably a biaxially extended film which is extended both in a vertical direction and in a lateral direction, from a viewpoint of strength.

The external conductor 40 is provided on the film layer 30. As the external conductor 40, it is possible to use, for example, a braided structure which is formed by bundling conductive wires such as copper wires into a plurality of bundles, and by braiding these bundles. Further, the external conductor 40 is not limited to the braided structure, but may be formed of a metallic film of metal foil. Further, the external conductor 40 may be composed of two or more layers. In addition, in case where the external conductor 40 is composed of the two or more layers, an insulator may be interposed between the layers.

The sheath 50 is so provided as to cover an outer periphery of the external conductor. The sheath 50 may be formed of, for example, resin which contains a plasticizer such as polyvinyl chloride resin (PVC).

The coaxial wire 1 is intended to interrupt noises in the exterior thereby to prevent superposition of the noises on the data which are transmitted through the internal conductor 10.

Further, even in case where the wiring harness WH including the coaxial wire 1 is exposed to high temperature environment and the plasticizer contained in the sheath 50 is volatilized, the volatilized plasticizer is blocked by the film layer 30. For this reason, the plasticizer will not be transferred to the internal insulator 20. As the results, the dielectric constant of the internal insulator 20 will not be enhanced due to the plasticizer, and deterioration of the shielding performance of the coaxial wire 1 (consequently, the wiring harness WH) can be prevented.

Further, the internal insulator 20 and the film layer 30 are fused to each other. Specifically, on a boundary between the internal insulator 20 and the film layer 30, at least one of the internal insulator 20 and the film layer 30 is softened and brought into tight contact with the other.

Figure 4A:
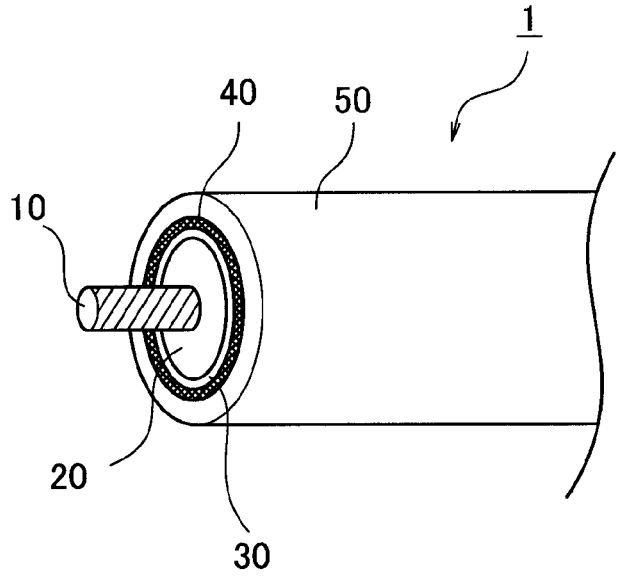
Figure 4B:
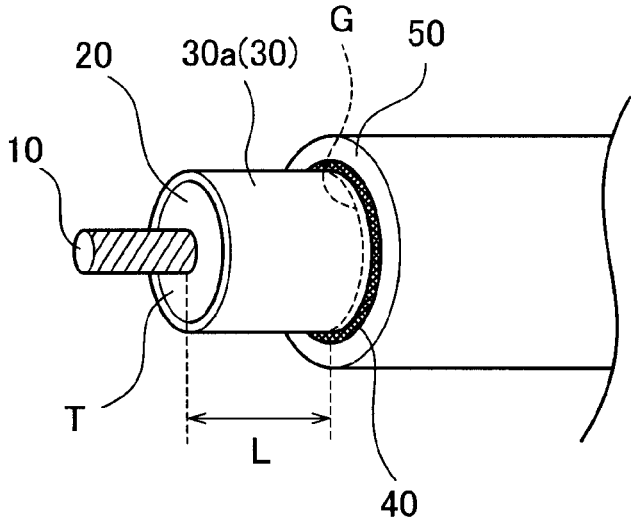

FIGS. 4A and 4B are views showing working processes when the coaxial wire is used, of which FIG. 4A shows a first process, and FIG. 4B shows a second process. When the coaxial wire 1 is used, the following processes are carried out.

As a first step, the internal conductor 10 is exposed, as shown in FIG. 4A, by peeling off four layers including the sheath 50 to the internal insulator 20, from the internal conductor 10 (a first cutting process). Then, as shown in FIG. 4B, two layers including the sheath 50 and the external conductor 40 are cut off at a position separated from an end face T of the internal insulator 20 by a predetermined length L (a second cutting process). In this manner, the internal conductor 10 and the external conductor 40 are separated from each other by the length L in a longitudinal direction of the coaxial wire 1 so that contact between the both conductors can be prevented.

However, when the two layers including the sheath 50 and the internal conductor 40 are cut off, damage (a gap G) may occur in the film layer 30 by the rotary cutter or the like, in some cases. On this occasion, there is such possibility that a film portion 30*a* at a distal end side from the gap G may be peeled off from the internal insulator 20, unless the film layer 30 is sufficiently fixed to the internal insulator 20. Then, in case where the film portion 30*a* covers the internal conductor 10 which is exposed, there is such possibility that defective connection may occur, when the internal conductor 10 and a terminal or the like are connected (press-fitted) to each other.

On the other hand, in this embodiment, because the internal insulator 20 and the film layer 30 are fused to each other, even though the gap G happens to be formed in the film layer 30 in the second cutting process, it is possible to prevent the defective connection caused by such phenomenon that the film portion 30*a* is peeled off and the film portion 30*a* which is peeled off covers the internal conductor 10. This is because the film portion 30*a* from the gap G to the end face T of the internal insulator 20 is in tight contact with the internal insulator 20.

In this case, a contact force between the internal insulator 20 and the film layer 30 is preferably 1N or more. This is because according to a test carried out by the inventor, in case where the contact force is 1N or more, removal of the film layer did not occur in all of a sufficient number of samples (the number of the samples was 50), on condition that the distance of the film portion in the longitudinal direction of the wire (the above described length L) is about 0.5 mm.

Figure 5A:
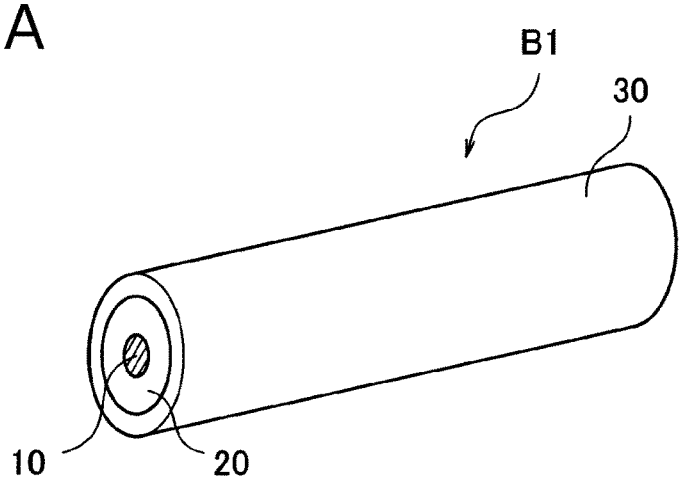
Figure 5B:
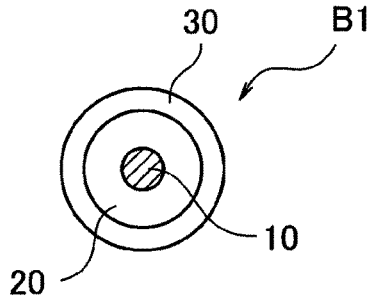
Figure 5C:
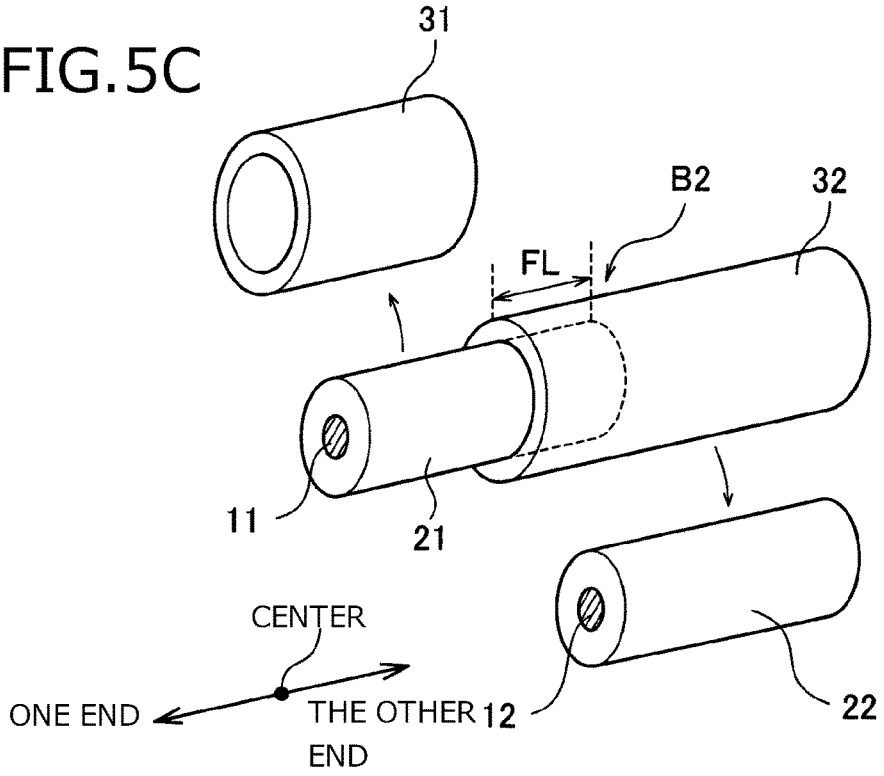

Specifically, this test was carried out as shown in FIGS. 5A to 5C. FIGS. 5A to 5C are views showing a method of measuring the contact force. FIG. 5A shows a first view, FIG. 5B shows a second view, and FIG. 5C shows a third view.

As a first step, a test piece (a sample) for measurement is produced. Specifically, as shown in FIGS. 5A and 5B, a first member B1 is produced, by removing the external conductor 40 and the sheath 50 from the coaxial wire 1. In other words, the first member B1 is composed of the internal conductor 10, the internal insulator 20 covering the internal conductor 10, and the film layer 30 covering the internal insulator 20.

Then, a second member B2 which is shown in FIG. 5C is produced. Specifically, a film layer 31 at one end side of the first member B1 is removed thereby to leave a film layer 32 at the other end side and in a center part. Thereafter, an internal conductor 12 and an internal insulator 21 at the other end side are removed, thereby to leave an internal conductor 11 and an internal insulator 21 at the one end side and in the center part. In this manner, the second member B2 which is the test piece for measurement is produced.

As shown in FIG. 5C, the internal insulator 21 and the film layer 32 are in a state fused to each other, in the center part of the second member B2. In this embodiment, a portion which is fused has a distance FL in the longitudinal direction, and the internal insulator 20 has a circumference of about 5 mm. Therefore, a fused area is about 50 $mm^2$.

Thereafter, the internal insulator 21 at the one end side of the second member B2 is pulled to the one end side (in the axial direction), and at the same time, the film layer 32 at the other end side is pulled to the other end side (in the axial direction). In short, forces are applied so that the both members can be separated from each other in the longitudinal direction of the second member B2. Then, the force when the film layer 32 in the center part of the second member B2 is peeled off from the internal insulator 21 is defined as the contact force.

For information, a test machine manufactured by TOYO SEIKI SEISAKUSHO KK (product name: STROGRAPH VGS) was used, as a pulling test machine for applying the forces for separating the both members from each other.

Then, a method of manufacturing the wiring harness WH according to this embodiment will be described. As a first step, the other electric wire 2 and the coaxial wire 1 are individually produced. The other electric wire 2 is produced by extruding the insulator 4 onto the conductor part 3. On the other hand, the coaxial wire 1 is produced by extruding the internal insulator 20 onto the internal conductor 10, as a first step. Then, the film layer 30 is formed by wrapping a film over the internal insulator 20. Thereafter, the external conductor 40 formed of, for example, a braided body is wrapped over the film layer 30. The member which has been formed in this manner (the member in which only the sheath 50 is removed from the coaxial wire 1) is called as a sheath inside member.

Thereafter, the sheath inside member is heated. In this manner, the film layer 30 is fused to the internal insulator 20. In this case, heating temperature is, for example, higher than 80° C. and lower than 120° C., and heating time is longer than 1 sec. and shorter than 5 sec. As the results, fusing is realized, in case where the film layer 30 is formed of, for example, PET resin, because the PET resin is softened at about 70° C. It is to be noted that although a melting point of the PET resin is 250° C. to 260° C., the film layer 30 need not be heated up to this temperature. This is because the film resin is collapsed and formed with holes or the like, when it is heated up to this temperature, and function of preventing transfer of the plasticizer is lost. Specifically, the heating temperature has only to be lower than the melting point of the resin composing the film layer 30, and higher than the temperature at which the resin composing the film layer 30 is softened (glass transition temperature).

Then, the sheath 50 is extruded onto the sheath inside member which has been heated. As the results, the coaxial wire 1 in this embodiment is produced. In the above description, the sheath inside member is heated at least higher than the glass transition temperature of the resin composing the film layer 30. In this manner, the extrusion can be smoothly conducted.

More specifically describing, in case where the sheath inside member is not heated, the extrusion is made with respect to the sheath inside member in a cold state. In this case, the sheath inside member in the cold state lowers the temperature of the resin for forming the sheath 50, during the extrusion. Specifically, even though the resin is extruded, the resin for forming the sheath 50 is rather hardened due to a drop of the temperature, and the extrusion cannot be appropriately carried out, in some case.

Specifically, in the process for heating the sheath inside member, the sheath inside member must be heated for the purpose of softening the film layer 30, and for the purpose of smoothing the succeeding extruding process.

As a method of heating the sheath inside member, it is possible to adopt at least one of a method of exposing the sheath inside member itself to a heating atmosphere, and a method of energizing the external conductor 40 of the sheath inside member.

Thereafter, the PVC wire and the coaxial wire 1 which have been individually produced are wrapped with a tape or the like, and thus, the wiring harness WH is produced.

As described hereinabove, according to the wiring harness WH in this embodiment, the coaxial wire 1 is provided with the film layer 30 for preventing transfer of the plasticizer between the internal insulator 20 and the sheath 50. Therefore, in case where the sheath 50 of the coaxial wire 1 contains the plasticizer, and in case where the insulator 4 of the electric wire 2 which is arranged adjacent to the coaxial wire 1 contains the plasticizer, it is possible to prevent the plasticizer from being transferred to the internal insulator 20 of the coaxial wire 1. As the results, it is possible to provide the wiring harness WH capable of restraining deterioration of the shielding function of the coaxial wire 1.

Further, the internal insulator 20 and the film layer 30 are fused to each other. Therefore, even though the gap G happens to be formed in the film layer 30, the film portion 30*a* from the gap G up to the end face T of the internal insulator 20 is tightly adhered to the internal insulator 20, and such possibility that the film portion 30*a* is peeled off and covers the internal conductor 10 can be reduced. As the results, it is possible to reduce possibility of occurring defective press-fitting.

Still further, the contact force between the internal insulator 20 and the film layer 30 is 1N or more. Therefore, it is possible to more reliably reduce the possibility of occurring the defective press-fitting.

Although the invention has been heretofore described referring to the embodiment, the invention is not limited to the above described embodiment, but modifications may be added within a scope not deviating from the gist of the invention.

For example, in the coaxial wire 1 in this embodiment, the film layer 30, the external conductor 40 and the sheath 50 are sequentially laminated on a piece of the inner wire which is formed by covering the internal conductor 10 with the internal insulator 20. However, the invention is not limited to this, but the coaxial wire 1 may be so formed as to include the film layer 30 for covering a plurality of the inner wires in a bundle, the external conductor 40 provided on the film layer 30, and the insulating sheath 50 covering the outer periphery of the external conductor 40.

Further, in this embodiment, the film layer 30 is fused over 360° of an entire circumference of the internal insulator 20. However, the internal insulator 20 and the film layer 30 may have such a structure that a part of the circumference is fused and the other parts are not fused.

Now, features of the above described wiring harness and the coaxial wire in the embodiment according to the invention will be briefly described below in items (1) to (5).

(1) A wiring harness (WH) including:

an electric wire (2) having a conductor part (3) and an insulator (4), the insulator (4) covering an outer periphery of the conductor part and containing a plasticizer; and a coaxial wire (1) having an internal conductor (10), an internal insulator (20), an external conductor (40), and a sheath (50), the internal insulator (20) provided on an outer periphery of the internal conductor, the external conductor (40) provided on an outer periphery of the internal insulator, and the sheath (50) covering an outer periphery of the external conductor, wherein the coaxial wire is arranged adjacent to the electric wire; and wherein the coaxial wire includes a film layer (30) which is arranged between the internal insulator and the sheath and which prevents transfer of the plasticizer.

(2) The wiring harness as descried in the above item (1), wherein the film layer is provided between the internal insulator and the external conductor, and is fused to the internal insulator.

(3) The wiring harness as described in the above item (2), wherein a contact force between the internal insulator and the film layer is 1N or more.

(4) A coaxial wire including an internal conductor (10);

an internal insulator (20) provided on an outer periphery of the internal conductor;

a film layer (30) provided on an outer periphery of the internal conductor for preventing transfer of a plasticizer;

an external conductor (40) provided on the film layer; and an insulative sheath (50) covering an outer periphery of the external conductor, wherein the internal insulator and the film layer are fused to each other.

(5) The coaxial wire as described in the above item (4), wherein a contact force between the internal insulator and the film layer is 1N or more.

According to the present invention, it is possible to restrain deterioration of the shielding performance of the wiring harness and the coaxial wire. The invention which attains this advantage is usefully applied to the wiring harness and the coaxial wire.

What is claimed is:

1. A wiring harness comprising:

an electric wire having a conductor part and an insulator, the insulator covering an outer periphery of the conductor part and containing a plasticizer; and a coaxial wire having an internal conductor, an internal insulator, an external conductor, and a sheath, the internal insulator provided on an outer periphery of the internal conductor, the external conductor provided on an outer periphery of the internal insulator, and the sheath covering an outer periphery of the external conductor, wherein the coaxial wire is arranged adjacent to the electric wire;

wherein the coaxial wire comprises a film layer which is provided between the internal insulator and the external conductor and which prevents transfer of the plasticizer;

wherein the internal insulator and the film layer are fused to each other; and wherein a contact force between the internal insulator and the film layer is 1N or more.

2. A coaxial wire comprising:

an internal conductor;

an internal insulator provided on an outer periphery of the internal conductor;

a film layer provided on an outer periphery of the internal conductor for preventing transfer of a plasticizer;

an external conductor provided on the film layer; and an insulative sheath covering an outer periphery of the external conductor, wherein the internal insulator and the film layer are fused to each other; and wherein a contact force between the internal insulator and the film layer is 1N or more.

* * * * *